US010176766B2

(12) United States Patent
Shang et al.

(10) Patent No.: US 10,176,766 B2
(45) Date of Patent: Jan. 8, 2019

(54) DISPLAY DRIVING METHOD AND APPARATUS AND DISPLAY DEVICE COMPRISING THE DISPLAY DRIVING APPARATUS

(71) Applicant: BOE TECHNOLOGY GROUP CO., LTD., Beijing (CN)

(72) Inventors: Guangliang Shang, Beijing (CN); Yinling Wang, Beijing (CN); Yanfeng Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/507,884

(22) PCT Filed: Mar. 4, 2016

(86) PCT No.: PCT/CN2016/075646
§ 371 (c)(1),
(2) Date: Mar. 1, 2017

(87) PCT Pub. No.: WO2017/054413
PCT Pub. Date: Apr. 6, 2017

(65) Prior Publication Data

US 2017/0301297 A1 Oct. 19, 2017

(30) Foreign Application Priority Data

Sep. 28, 2015 (CN) ..... 2015 1 0626973

(51) Int. Cl.
*G09G 5/10* (2006.01)
*G09G 3/34* (2006.01)
*G09G 3/36* (2006.01)

(52) U.S. Cl.
CPC ..... *G09G 3/342* (2013.01); *G09G 3/3648* (2013.01); *G09G 5/10* (2013.01);
(Continued)

(58) Field of Classification Search
USPC ..... 345/92, 690, 691, 102
See application file for complete search history.

(56) References Cited

U.S. PATENT DOCUMENTS

2005/0184952 A1* 8/2005 Konno ..... G09G 3/3426 345/102
2007/0273678 A1 11/2007 Okita et al.
(Continued)

FOREIGN PATENT DOCUMENTS

CN 101105930 A 1/2006
CN 1761988 A 4/2006
(Continued)

OTHER PUBLICATIONS

Search Report and Written Opinion dated Jun. 27, 2016 from State Intellectual Property Office of the P.R. China.
First Chinese Office Action dated Apr. 27, 2017.

*Primary Examiner* — Thuy Pardo
(74) *Attorney, Agent, or Firm* — Dilworth & Barrese, LLP.; Michael J. Musella, Esq.

(57) ABSTRACT

A display driving method is provided. The method comprises: determining whether scanning of at least one area of display areas is completed (S1); adjusting light-emitting luminance of display light source corresponding to the at least one area after the scanning of the at least one area is completed, such that display luminance of the at least one area maintains within a specified range to eliminate picture flicker (S2). The display driving method is capable of reducing commendably the change of display luminance of the at least one area by adjusting the light-emitting luminance of display light source corresponding to the at least one area, so that picture flicker caused by over change of the display luminance would be avoided. There are provided a
(Continued)

display driving method and apparatus and a display device comprising the display driving apparatus.

18 Claims, 2 Drawing Sheets

(52) U.S. Cl.
CPC ... *G09G 2310/024* (2013.01); *G09G 2310/08* (2013.01); *G09G 2320/0247* (2013.01); *G09G 2320/064* (2013.01); *G09G 2320/0646* (2013.01)

(56) References Cited

U.S. PATENT DOCUMENTS

2009/0147176 A1 6/2009 Kron et al.
2011/0227962 A1* 9/2011 Shimizu ..... G09G 3/3426 345/690
2011/0285759 A1* 11/2011 Sakai ..... G09G 3/3648 345/690
2012/0274667 A1* 11/2012 Kuwayama ..... G09G 3/342 345/690
2014/0085347 A1* 3/2014 Yatabe ..... G09G 3/3677 345/690
2014/0210869 A1* 7/2014 Mizushiro ..... G09G 3/003 345/690
2014/0267464 A1* 9/2014 Takamaru ..... G09G 3/3406 345/690
2015/0062486 A1* 3/2015 Kuwayama ..... G09G 3/342 349/61
2015/0102988 A1* 4/2015 Suzuki ..... G09G 3/3648 345/92
2015/0103107 A1* 4/2015 Kobayashi ..... G09G 3/3413 345/691
2015/0325163 A1* 11/2015 Kobayashi ..... G02F 1/13476 345/690
2016/0086583 A1* 3/2016 Oshima ..... H04N 5/445 345/629
2016/0196781 A1* 7/2016 Tanaka ..... G09G 3/3648 345/691
2017/0039967 A1* 2/2017 Jung ..... G09G 3/3648 345/690

FOREIGN PATENT DOCUMENTS

CN 1811536 A 8/2006
CN 1811539 A 8/2006
CN 1847934 A 10/2006
CN 101029987 A 9/2007
CN 101059609 A 10/2007
CN 101142612 A 3/2008
CN 101727846 A 6/2010
CN 102592554 A 7/2012
CN 103377632 A 10/2013
CN 103714779 A 4/2014
CN 104505026 A 4/2015
CN 105139810 A 12/2015
EP 1091342 A2 4/2001

* cited by examiner

DISPLAY DRIVING METHOD AND APPARATUS AND DISPLAY DEVICE COMPRISING THE DISPLAY DRIVING APPARATUS

TECHNICAL FIELD

The present disclosure relates to a display driving method and apparatus and a display device comprising the display driving apparatus.

BACKGROUND

In order to prolong service time of a mobile product, there is proposed a low frequency drive technique at present. Such low frequency drive technique reduces power consumption of the mobile product which are displaying by reducing refresh frequency of the display device. However, such technique would prolong the time of one frame. In actual application, due to existence of leakage current, pixel voltage in a liquid crystal display device would gradually drop with time. This would lead to change of luminance. For example, for a display driving device in a normally black mode, as a pixel voltage within one frame declines gradually, it would cause display luminance decrease gradually, thereby resulting in picture flicker. Such a phenomenon is particularly evident in the liquid crystal display device that adopts the low frequency drive technique.

SUMMARY

There are provided in some embodiments of the present disclosure a display driving method, a display driving apparatus and a display device comprising the display driving apparatus. According to a first aspect of the present disclosure, there is provided a display driving method, comprising:

determining whether scanning of at least one area of display areas is completed;

adjusting light-emitting luminance of display light source corresponding to the at least one area after scanning of the at least one area is completed, such that display luminance of the at least one area maintains within a specified range.

Further, in the case of driving a liquid crystal display device in a normally black mode, the adjusting light-emitting luminance of display light source corresponding to the at least one area includes: adjusting light-emitting luminance of display light source corresponding to the at least one area according to following luminance adjustment formula:

$$C_t:C_t=C_0*e^{t/\tau};$$

where $C_0$ is light-emitting luminance of display light source corresponding to the at least one area at an adjustment starting moment, t is time length between a current moment and the adjustment starting moment, and $\tau$ is a product of a pixel leakage resistance and a pixel capacitance.

Further, in the case of driving a liquid crystal display device in a normally white mode, the adjusting light-emitting luminance of display light source corresponding to the at least one area comprises: adjusting light-emitting luminance of display light source corresponding to the at least one area according to following luminance adjustment formula:

$$C_t:C_t=C_0*e^{-t/\tau};$$

where $C_0$ is light-emitting luminance of display light source corresponding to the at least one area at an adjustment starting moment, t is time length between a current moment and the adjustment starting moment, and $\tau$ is a product of a pixel leakage resistance and a pixel capacitance.

Further, the adjusting light-emitting luminance of display light source corresponding to the at least one area comprises:

adjusting light-emitting luminance of display light source corresponding to the at least one area by means of pulse width modulation.

Further, the display area comprises a plurality of areas, each of which is corresponding to an independent group of display light sources;

The adjusting light-emitting luminance of display light source corresponding to the at least one area comprises:

adjusting light-emitting luminance of display light source corresponding to each area sequentially in a scanning order of each area.

Further, the adjusting light-emitting luminance of display light source corresponding to the at least one area comprises:

adjusting light-emitting luminance of display light source corresponding to an entire display area after scanning of the entire display area is completed.

Further, before adjusting light-emitting luminance of display light source corresponding to the at least one area, the method further comprises:

acquiring a luminance adjustment formula which is appropriate for making display luminance after scanning of the at least one area is completed maintain within the specified range;

the adjusting light-emitting luminance of display light source corresponding to the at least one area: adjusting light-emitting luminance of display light source corresponding to the at least one area according to an acquired luminance adjustment formula.

Further, the method further comprises:

determining a scanning period of time of the at least one area;

adjusting light-emitting luminance of display light source corresponding to the at least one area to a predetermined initial light-emitting luminance within a determined scanning period of time.

There is further provided according to a second aspect of the present disclosure a display driving apparatus, comprising:

a determining module, configured to determine whether scanning of at least one area of display areas is completed;

an adjusting module, configured to adjust light-emitting luminance of display light source corresponding to the at least one area after scanning of the at least one area is completed, such that display luminance of the at least one area maintains within a specified range.

Further, the display driving apparatus further comprises: a pulse width modulating module.

The adjusting module is configured to generate a control signal used to control the pulse width modulating module after scanning of the at least one area is completed;

The pulse width modulating module is configured to receive the control signal, perform pulse modulation according to the control signal, and adjust light-emitting luminance of display light source corresponding to the at least one area.

Further, the display area comprises a plurality of areas, each of which is corresponding to an independent group of display light sources;

The adjusting module is configured to adjust light-emitting luminance of display light source corresponding to each area sequentially in a scanning order of each area.

Further, the adjusting module is configured to adjust light-emitting luminance of display light source corresponding to an entire display area after scanning of the entire display area is completed.

Further, the display driving apparatus further comprises:

an acquiring module, configured to acquire a luminance adjustment formula which is appropriate for making display luminance after scanning of the at least one area is completed maintain within the specified range;

The adjusting module is configured to adjust light-emitting luminance of display light source corresponding to the at least one area according to an acquired luminance adjustment formula.

Further, the determining module is configured to determine a scanning period of time of the at least one area;

The adjusting module is further configured to adjust light-emitting luminance of display light source corresponding to the at least one area to a predetermined initial light-emitting luminance within the scanning period of time determining by the determining module.

There is provided according to a third aspect of the present disclosure a display device, comprising the display driving apparatus described above.

The backlight source driving method provided in some embodiments of the present disclosure is capable of reducing commendably the change of display luminance of the at least one area by adjusting the light-emitting luminance of display light source corresponding to the at least one area, so that picture flicker caused by over change of the display luminance would be avoided.

DETAILED DESCRIPTION

In order to make principles, technical solutions and advantages of embodiments of the present disclosure more clear, technical solutions in the embodiments of the present disclosure will be described clearly and completely by combining with accompanying figures. Obviously, embodiments described below are just a part of embodiments of the present disclosure, but not all the embodiments.

Figure 1:
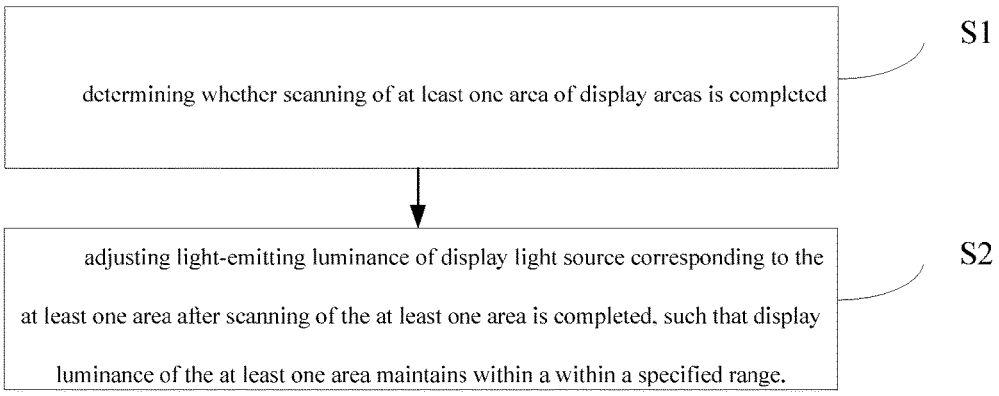
FIG. 1 is a schematic diagram of flows of a display driving method provided in an embodiment of the present disclosure.

FIG. 1 shows a schematic diagram of flows of a display driving method provided in an embodiment of the present disclosure. Exemplarily, there is provided in the embodiment a driving method of backlight source. As shown in FIG. 1, the driving method of backlight source comprises following steps:

In step S1, determining whether scanning of at least one area of display areas is completed;

In step S2, adjusting light-emitting luminance of display light source corresponding to the at least one area after scanning of the at least one area is completed, such that display luminance of the at least one area maintains within a specified range.

The display driving method provided in the embodiments of the present disclosure is capable of reducing change of display luminance of the at least one area by adjusting the light-emitting luminance of display light source corresponding to the at least one area, so that picture flicker caused by excessive change of the display luminance would be avoided.

Alternatively, there could be many kinds of ways to implement step S1 in the above driving method of backlight source, for example, determining that scanning of the at least one area is completed according to a trigger signal produced by a gate driving circuit after scanning of the area is completed, or determining whether at least one area of display areas is completed or not according to a preset timer (for example, when the at least one area herein is an entire display area, one timer can be set when each frame starts. A length of the timer is a time length required for scanning the entire display area. Then, when timing of the timer is completed, it can be determined that scanning of this area is completed). How to specifically determine whether the scanning of one area is completed may be implemented through a variety of ways. Examples are not given one by one herein.

Upon specific implementation, the process of adjusting light-emitting luminance of display light source corresponding to the at least one area may continue until scanning of at least one area in a next frame starts, so that luminance maintains consistent before the at least one area is scanned in the next frame. Also, the process of adjusting may just continue to the time when the next frame starts, only to make the display luminance of the at least one area within the current frame maintain unchanged, or the process of adjusting may continue to other time nodes before scanning of the area in the next frame starts.

In specific implementation, the above method can further comprise steps not shown in FIG. 1:

determining a scanning period of time of the at least one area; and adjusting light-emitting luminance of display light source corresponding to at least one area to a predetermined initial light-emitting luminance within a determined scanning period of time.

Since it is very likely that the light-emitting luminance of the area may change when the at least one area is scanned (when displayed pictures change, display gray scales of a plurality of areas change), and degree of deflection of a corresponding liquid crystal is also reset, adjusting light-emitting luminance of display light source back to a predetermined initial light-emitting luminance within this period of time is capable of avoiding human eyes from feeling flicker of a same picture better than adjusting back within other periods of time.

It is easy to understand that, maintaining the display luminance within a specified range as described in the present disclosure means that in the area, amplitude of fluctuation of display luminance after completion of scanning relative to display luminance upon completion of scanning or at a certain moment in the process of scanning is smaller than a value which can make human eyes feel flicker. In specific implementation, the maximum value and minimum value of the above specified range can be set according to actual requirements only if the value satisfies a requirement of being capable of eliminating flicker of the display picture.

Exemplarily, adjusting light-emitting luminance of display light source corresponding to the at least one area can refer to adjusting dynamically the light-emitting luminance of display light source corresponding to the area according to a certain cycle after scanning of the at least one area is completed, so that the light-emitting luminance of display light source corresponding to the area compensates for the change of display luminance caused by factors such as decrease of pixel voltage within this area, so as to make the total display luminance maintain within a specified range.

The display driving method provided in the embodiment of the present disclosure can be used to drive backlight source of a liquid crystal display device in a normally black mode. Herein, as an example, adjusting light-emitting luminance of display light source corresponding to the at least one area can comprise: adjusting light-emitting luminance of display light source corresponding to the at least one area according to following luminance adjustment formula: $C_t$: $C_t=C_0*e^{t/\tau}$; where $C_0$ is light-emitting luminance of display light source corresponding to the at least one area at an adjustment starting moment, t is time length between a current moment and the adjustment starting moment, and $\tau$ is a product of a pixel leakage resistance and a pixel capacitance. The pixel leakage resistance herein can in particular refer to resistance on a loss path with charges of pixel electrodes. In particular, it may refer to equivalent resistance of all materials causing leakage of the pixel electrodes and contacting with the pixel electrodes, such as source and drains of thin film transistors, liquid crystal layers, etc. In specific implementation, the specific value of $\tau$ herein can be measured by experiment.

In the process of liquid crystal displaying, the rule that a pixel voltage $V_t$ written into respective pixels changes frequently keeps to: $V_t=e^{-t/\tau}*V_0$, where $V_0$ is an initial voltage of the pixel voltage, that is, the pixel voltage $V_t$ reduces gradually as time increases. Correspondingly, in a liquid crystal display device in the normally black mode, the rule that transmittance $T_t$ changes with time also keeps to: $T_t=a*e^{-t/\tau}$, where a is a constant relevant to a liquid crystal display device to be driven, and can be measured by experiment. Thus it can be seen that the longer the time is, the greater the transmittance changes, which would result in an apparent flicker phenomenon in a conventional low-frequency driven display device. And as to the display luminance of the screen, $B_t=C*T_t$. In this way, the luminance C of the display light source can be adjusted correspondingly, and thus the display light source luminance C also changes with time, so that the display luminance $B_t$ maintain stable. Then, in order to make $C_t*T_t==B_0$, $C_t=B_0/T_t=C_0*T_0/T_t=C_0*a/(a*e^{-t/\tau})=C_0*e^{t/\tau}$ can be obtained, where $B_0$ is display luminance at the moment of starting adjustment, such that the display luminance does not change with time substantially. In this way, the apparatus that executes the above display driving method can realize the corresponding adjusting process without performing complicated calculations.

Figure 2:
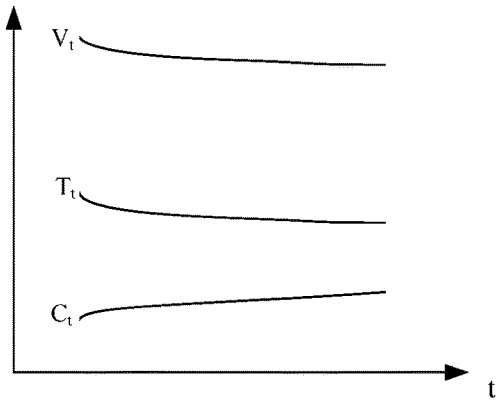
FIG. 2 is a curve diagram of change of a part of parameters when a normally black liquid crystal display device is driven by utilizing a display driving method provided in an embodiment of the present disclosure.

FIG. 2 shows a curve diagram of change of a part of parameters when a normally black liquid crystal display device is driven by utilizing a display driving method provided in an embodiment of the present disclosure. Referring to FIG. 2, it shows a curve diagram of change of the light-emitting luminance $C_t$ of the display light source of the area with the pixel voltage $V_t$ and the transmittance $T_t$, after the scanning of the area in the random frame is completed and before the area is scanned in a next frame of a random frame, in the process that the driving method provided in the embodiment of the present disclosure drives backlight source of the liquid crystal display device in the normally black mode, where the pixel voltage $V_t$ and the transmittance $T_t$ reduce gradually with time while the light-emitting luminance $C_t$ of the display light source increases gradually with time, so as to avoid the actual display luminance from changing greatly due to decrease of the transmittance $T_t$.

Further, in a liquid crystal display apparatus in a normally white mode, the rule that respective pixel transmittance $T_t$ changes with time keep to: $T_t=a*e^{t/\tau}$. Correspondingly, the light-emitting luminance C of display light source can be adjusted correspondingly, and thus the light-emitting luminance C of the display light source also changes with time, so that the display luminance $B_t$ keeps stable. In order to make that $C_t*T_t==B_0$, $C_t=B_0/T_t=C_0*T_0/T_t=C_0*a/(a*e^{t/\tau})=C_0*e^{-t/\tau}$ can be obtained. In the liquid crystal display device in the normally white mode, adjusting of light-emitting luminance of display light source corresponding to the at least one area can include: adjusting light-emitting luminance $C_t$, of display light source corresponding to the at least one area according to following luminance adjustment formula:

$$C_t: C_t=C_0*e^{-t/\tau}.$$

Figure 3:
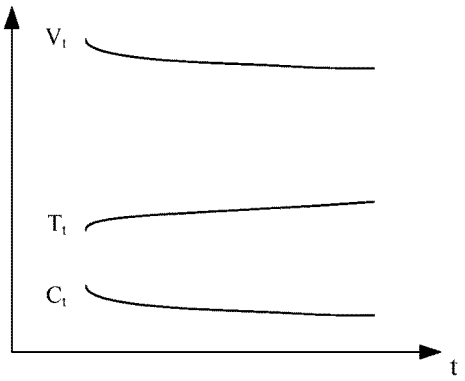
FIG. 3 is a curve diagram of change of a part of parameters when a normally white liquid crystal display device is driven by utilizing a display driving method provided in an embodiment of the present disclosure.

FIG. 3 is a curve diagram of change of a part of parameters when a normally white liquid crystal display device is driven by utilizing a display driving method provided in an embodiment of the present disclosure. Referring to FIG. 3, it shows a curve diagram of change of the light-emitting luminance $C_t$ of the backlight source of the area with the pixel voltage $V_t$ and the transmittance $T_t$, after the scanning of the area in the random frame is completed and before the area is scanned in a next frame of a random frame, in the process that the driving method provided in the embodiment of the present disclosure drives backlight source in the liquid crystal display device in the normally white mode, where the pixel voltage $V_t$ reduces gradually with time while the transmittance $T_t$ increases gradually with time. Since the light-emitting luminance $C_t$ of the display light source decreases gradually with time, it is capable of avoiding the actual display luminance from changing greatly due to increase of transmittance $T_t$.

In a specific implementation, the above display area can comprise a plurality of areas, each of which is corresponding to an independent group of display light sources.

At this time, in the above driving method, the step S2 can refer to:

adjusting sequentially light-emitting luminance of display light source corresponding to each area in a scanning order of each area.

In specific implementation, the display area can be divided into a plurality of areas, each different display area is corresponding to a different display light source, each area is scanned separately, and after scanning of a first area is completed, display light source corresponding to the first area is adjusted; after scanning of a second area is completed, display light source corresponding to the second area is adjusted, adjusting of display light source corresponding to each area is performed after scanning of the area is completed, which reduces change of display luminance of the entire display area to the better.

Figure 4:
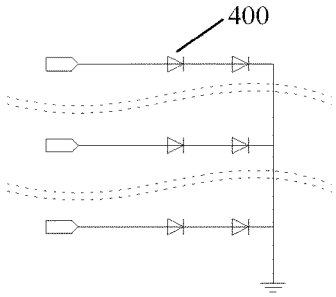
FIG. 4 is a schematic diagram of an internal structure of a backlight source.

FIG. 4 is a schematic diagram of structure of a usual backlight source, comprising multiple rows of display light sources 400 independent from each other. Each row of independent display light source 400 is corresponding to one display area. As such, upon scanning, when scanning of a display area corresponding to a first row of display light source is completed, it can start to adjust light-emitting luminance of the display area.

In this way, it is capable of timely starting the process of adjusting the light-emitting unit of the row after scanning of one area corresponding to each row of display light source 400 is completed, so as to stabilize the display luminance of the area timely. Compared with the mode of adjusting luminance after the scanning of display images of the entire display area is completed, it is capable of further reducing change of display luminance of a display area scanned previously, so as to avoid picture flicker to the better.

Of course, in actual application, the aforementioned at least one area can be the entire display area. Then, the step S2 can be: adjusting light-emitting luminance of display light source corresponding to the entire display area after the scanning of the entire display area is completed.

Such mode is capable of having lower difficulty in controlling, and is convenient to design the apparatus for executing the above method.

Alternatively, in the step S2, the light-emitting luminance of the display light source corresponding to the at least one area can be adjusted by adopting the pulse width modulation mode. In particular, the light-emitting current of the display light source of the area can be adjusted dynamically by adopting the pulse width modulation mode, so as to adjust the light-emitting luminance of the display light source of the corresponding area. The pulse width modulation mode herein mainly refers to a mode of modulating by adjusting a duty ratio of the pulse within each cycle. Within each cycle, the greater the pulse width is, the larger the duty ratio of the pulse is, and then the average value of the current within the corresponding cycle is higher, so that the light-emitting luminance becomes larger.

Figure 5:
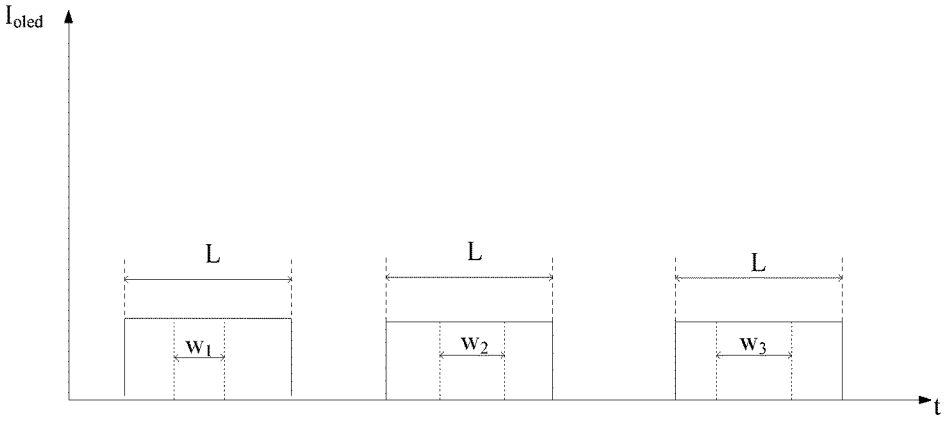
FIG. 5 is a schematic diagram of change of pulse width in a display driving method provided in an embodiment of the present disclosure.

FIG. 5 shows a schematic diagram of change of pulse width in a display driving method provided in an embodiment of the present disclosure.

For example, referring to FIG. 5, in the normally black mode, a pulse width of a light-emitting current $I_{oled}$ corresponding to each adjustment cycle L can increase gradually with the time t. Referring to FIG. 5, a pulse width w3 within a third adjustment cycle L is greater than a pulse width w2 within a second adjustment cycle L, and a pulse width w2 within the second adjustment cycle L is greater than a pulse width w1 within a first adjustment cycle L. In this way, it makes that an average value of light-emitting currents of display light source of the area within the second adjustment cycle L is larger than an average value within the first adjustment cycle L, and an average value within the third adjustment cycle L is greater than the average value within the second adjustment cycle L, that is, the average value within each adjusting cycle L becomes greater and greater, so as to increase the light-emitting luminance of the display light source gradually.

In specific implementation, in the above method, prior to the step S2, the method can further comprise:

acquiring a luminance adjustment formula which is appropriate for making the display luminance, after scanning of the at least one area is completed, maintain within the specified range;

At this time, the step S2 can comprise: adjusting light-emitting luminance of display light source corresponding to the at least one area according to an acquired luminance adjustment formula.

Exemplarily, the mode of acquiring the luminance adjustment formula can be a mode of receiving the luminance adjustment formula imported artificially. For example, production staff can determine the parameter ti in the formula of $C_t=C_0*e^{-t/\tau}$ by means of experimental statistics, and then the corresponding calculation formula is imported to the apparatus that executes the above driving method.

There is further provided in another embodiment of the present disclosure a display driving apparatus, which can be used to execute the display driving method described above. The apparatus comprises:

a determining module, configured to determine whether scanning of at least one area of display areas is completed;

an adjusting module, configured to adjust light-emitting luminance of display light source corresponding to the at least one area after scanning of the at least one area is completed, such that display luminance of the at least one area maintains within a specified range.

The display driving apparatus provided in the embodiment of the present disclosure is capable of reducing change of display luminance of the at least one area by adjusting the light-emitting luminance of display light source corresponding to the at least one area, so that picture flicker caused by over change of the display luminance would be avoided.

Further, the display driving apparatus further comprises:

a pulse width modulating module;

the adjusting module is configured to generate a control signal used to control the pulse width modulating module after scanning of the at least one area is completed.

The pulse width modulating module is configured to receive the control signal, and perform pulse modulation according to the control signal so as to adjust light-emitting luminance of display light source corresponding to the at least one area.

In specific implementation, the determining module and the adjusting module can be realized by a programmable logic controller, while the pulse width modulation module herein can be realized by a pulse width modulation circuit. Under the condition of being capable of realizing the present disclosure, adopting what kind of form to implement the above respective functional modules specifically is not limited, the corresponding technical solution shall fall into the protection scope of the present disclosure.

Further, the display area comprises a plurality of areas, each of which is corresponding to an independent group of display light sources.

The adjusting module is configured to sequentially adjust light-emitting luminance of display light source corresponding to each area according to a scanning order of each area.

Further, the adjusting module is configured to adjust light-emitting luminance of display light source corresponding to an entire display area after scanning of the entire display area is completed.

Further, the display driving apparatus further comprises:

an acquiring module, configured to acquire a luminance adjustment formula which is appropriate for making the display luminance after scanning of the at least one area is completed maintain within the specified range; and the adjusting module is configured to adjust light-emitting luminance of display light source corresponding to the at least one area according to an acquired luminance adjustment formula.

Further, the determining module is configured to determine a scanning period of time of the at least one area; and the adjusting module is further configured to adjust light-emitting luminance of display light source corresponding to the at least one area to a predetermined initial light-emitting luminance within the scanning period of time determined by the determining module.

In another embodiment of the present disclosure, there is further provided a display device comprising the display driving apparatus described above.

The display device herein can be any product or elements having the display function, such as an electronic paper, a mobile phone, a tablet computer, a television set, a display, a notebook computer, a digital photo frame, and a navigator, etc.

The above descriptions are just specific implementations of the present disclosure. However, the protection scope of the present disclosure is not limited thereto. Any alternation or replacement that can be conceived by those skilled in the art who are familiar with the technical field shall be covered within the protection scope of the present disclosure. Therefore, the protection scope of the present disclosure shall be subjected to the protection scope of the claims.

The present application claims the priority of a Chinese patent application No. 201510626973.0 filed on Sep. 28, 2015. Herein, the content disclosed by the Chinese patent application is incorporated in full by reference as a part of the present disclosure.

What is claimed is:

1. A display driving method, comprising:

determining a scanning period of time of at least one area of display areas;

adjusting light-emitting luminance of display light source corresponding to the at least one area to a predetermined initial light-emitting luminance within a determined scanning period of time;

determining whether scanning of the at least one area is completed;

adjusting dynamically light-emitting luminance of display light source corresponding to the at least one area according to a certain cycle after the scanning of the at least one area is completed, such that display luminance of the at least one area maintains within a specified range to eliminate picture flicker; and adjusting light-emitting luminance of display light source corresponding to the at least one area to the predetermined initial light-emitting luminance, if the scanning of the at least one area is not completed.

2. The method according to claim 1, wherein in the case of driving a liquid crystal display device in a normally black mode, the adjusting light-emitting luminance of display light source corresponding to the at least one area comprises: adjusting light-emitting luminance of display light source corresponding to the at least one area according to following luminance adjustment formula:

$$C_t: C_t = C_0 * e^{t/\tau};$$

where $C_0$ is light-emitting luminance of display light source corresponding to the at least one area at an adjustment starting moment, t is time length between a current moment and the adjustment starting moment, and $\tau$ is a product of a pixel leakage resistance and a pixel capacitance.

3. The method according to claim 1, wherein in the case of driving a liquid crystal display device in a normally white mode, the adjusting light-emitting luminance of display light source corresponding to the at least one area includes: adjusting light-emitting luminance of display light source corresponding to the at least one area according to following luminance adjustment formula:

$$C_t: C_t = C_0 * e^{t/\tau};$$

where $C_0$ is light-emitting luminance of display light source corresponding to the at least one area at an adjustment starting moment, t is time length between a current moment and the adjustment starting moment, and $\tau$ is a product of a pixel leakage resistance and a pixel capacitance.

4. The method according to claim 1, wherein the adjusting light-emitting luminance of display light source corresponding to the at least one area comprises:

adjusting light-emitting luminance of display light source corresponding to the at least one area by means of pulse width modulation.

5. The method according to claim 1, wherein the display area comprises a plurality of areas, each of which is corresponding to an independent group of display light sources;

the adjusting light-emitting luminance of display light source corresponding to the at least one area comprises:

adjusting sequentially light-emitting luminance of display light source corresponding to each area according to a scanning order of each area.

6. The method according to claim 1, wherein the adjusting light-emitting luminance of display light source corresponding to the at least one area comprises:

adjusting light-emitting luminance of display light source corresponding to an entire display area after scanning of the entire display area is completed.

7. The method according to claim 1, wherein before adjusting light-emitting luminance of display light source corresponding to the at least one area, the method further comprises:

acquiring a luminance adjustment formula which is appropriate for making display luminance maintain within the specified range after scanning of the at least one area is completed;

the adjusting light-emitting luminance of display light source corresponding to the at least one area comprising: adjusting light-emitting luminance of display light source corresponding to the at least one area according to the acquired luminance adjustment formula.

8. A display driving apparatus, comprising:

a determining module, configured to determine a scanning period of time of at least one area of display areas and determine whether scanning of the at least one area is completed; and an adjusting module, configured to adjust light-emitting luminance of display light source corresponding to the at least one area to a predetermined initial light-emitting luminance within the scanning period of time determined by the determining module, adjust dynamically light-emitting luminance of display light source corresponding to the at least one area according to a certain cycle after the scanning of the at least one area is completed, such that display luminance of the at least one area maintains within a specified range, and adjust light-emitting luminance of display light source corresponding to the at least one area to the predetermined initial light-emitting luminance if the scanning of the at least one area is not completed.

9. The display driving apparatus according to claim 8, further comprising: a pulse width modulating module;

the adjusting module is configured to generate a control signal used to control the pulse width modulating module after scanning of the at least one area is completed; and the pulse width modulating module is configured to receive the control signal, and perform pulse modulation according to the control signal to adjust light-emitting luminance of display light source corresponding to the at least one area.

10. The display driving apparatus according to claim 8, wherein the display area comprises a plurality of areas, each of which is corresponding to an independent group of display light sources;

the adjusting module is configured to adjust sequentially light-emitting luminance of display light source corresponding to each area according to a scanning order of each area.

11. The display driving apparatus according to claim 8, wherein the adjusting module is configured to adjust light-emitting luminance of display light source corresponding to an entire display area after scanning of the entire display area is completed.

12. The display driving apparatus according to claim 8, further comprising:

an acquiring module, configured to acquire a luminance adjustment formula which is appropriate for making display luminance maintain within the specified range after scanning of the at least one area is completed;

the adjusting module is configured to adjust light-emitting luminance of display light source corresponding to the at least one area according to the acquired luminance adjustment formula.

13. A display device, comprising the display driving apparatus according to claim 8.

14. The display device according to claim 13, further comprising: a pulse width modulating module;

the adjusting module is configured to generate a control signal used to control the pulse width modulating module after scanning of the at least one area is completed; and the pulse width modulating module is configured to receive the control signal, and perform pulse modulation according to the control signal to adjust light-emitting luminance of display light source corresponding to the at least one area.

15. The display device according to claim 13, wherein the display area comprises a plurality of areas, each of which is corresponding to an independent group of display light sources;

the adjusting module is configured to adjust sequentially light-emitting luminance of display light source corresponding to each area according to a scanning order of each area.

16. The display device according to claim 13, wherein the adjusting module is configured to adjust light-emitting luminance of display light source corresponding to an entire display area after scanning of the entire display area is completed.

17. The display device according to claim 13, further comprising:

an acquiring module, configured to acquire a luminance adjustment formula which is appropriate for making display luminance maintain within the specified range after scanning of the at least one area is completed;

the adjusting module is configured to adjust light-emitting luminance of display light source corresponding to the at least one area according to the acquired luminance adjustment formula.

18. The display device according to claim 13, wherein the determining module is configured to determine a scanning period of time of the at least one area;

the adjusting module is further configured to adjust light-emitting luminance of display light source corresponding to the at least one area to a predetermined initial light-emitting luminance within the scanning period of time determined by the determining module.

* * * * *